United States Patent [19]

Sleep

[11] 4,352,327

[45] Oct. 5, 1982

[54] TOW TRUCK SELECTOR PIN

[75] Inventor: Craig Sleep, Bangor, Pa.

[73] Assignee: SI Handling Systems, Inc., Easton, Pa.

[21] Appl. No.: 871,680

[22] Filed: Jan. 23, 1978

[51] Int. Cl.[3] ..... B61B 12/00

[52] U.S. Cl. ..... 104/170; 104/88; 104/172 BT; 403/229

[58] Field of Search ..... 104/172 BT, 88, 140, 104/170; 403/229

[56] References Cited

U.S. PATENT DOCUMENTS

| | | | |
|---|---|---|---|
| 1,674,983 | 6/1928 | Morton | 403/229 X |
| 2,559,452 | 7/1951 | McLellan | 403/229 X |
| 2,816,516 | 12/1957 | Diehl | 104/88 |
| 3,373,698 | 3/1968 | Bishop | 104/88 |
| 3,437,059 | 4/1969 | Stonier et al. | 403/229 X |
| 3,532,059 | 10/1970 | Frantz | 104/88 |
| 3,556,012 | 1/1971 | Parshall | 104/172 BT X |
| 3,559,584 | 2/1971 | Frantz et al. | 104/172 BT UX |

*Primary Examiner*—Randolph A. Reese

*Attorney, Agent, or Firm*—Seidel, Gonda, Goldhammer & Panitch

[57] ABSTRACT

The selector pin for a tow truck is comprised of first and second tubes aligned end to end with a spring confined within the tubes and under tension to maintain the tubes in end-to-end alignment, while permitting one tube to pivot relative to the other tube through an arc up to 90°.

9 Claims, 4 Drawing Figures

TOW TRUCK SELECTOR PIN

BACKGROUND

The state of the art and the problems involved in connection with selector pins are believed to be set forth in U.S. Pat. No. 3,583,329. The disclosure of said patent is directed to a solution of the problem based on an interrelationship of particular materials which permit the selector pin to withstand deformation forces without permanent set. It is known to provide a selector pin which is an exposed coil spring or includes an exposed spring as a component thereof.

Thus, while the selector pin in some of said patents is satisfactory for the intended purpose, the present invention is an improvement which accomplishes substantially the same results in a substantially different manner while improving reliability and eliminating the need for special manufacturing equipment. Also, this invention provides a selector pin wherein one portion may pivot relative to the other portion through an arc up to 90°.

SUMMARY OF THE INVENTION

The selector pin of the present invention is comprised of first and second tubes which are aligned with one another in end to end contact. A spring is disposed within the tubes. The outer diameter of the spring closely approximates the inner diameter of the tubes. One end of the spring is anchored to the first tube and the other end of the spring is anchored to the second tube in a manner so that the spring is under tension and maintains the juxtaposed end faces in coaxial contact while permitting the second tube to pivot relative to the first tube when the second tube is subjected to a laterally directed force exceeding the spring tension.

It is an object of the present invention to provide a selector pin which is simple, inexpensive and reliable while permitting a contact end of the pin to deflect through an angle up to 90° and thereafter come back to perfect alignment.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
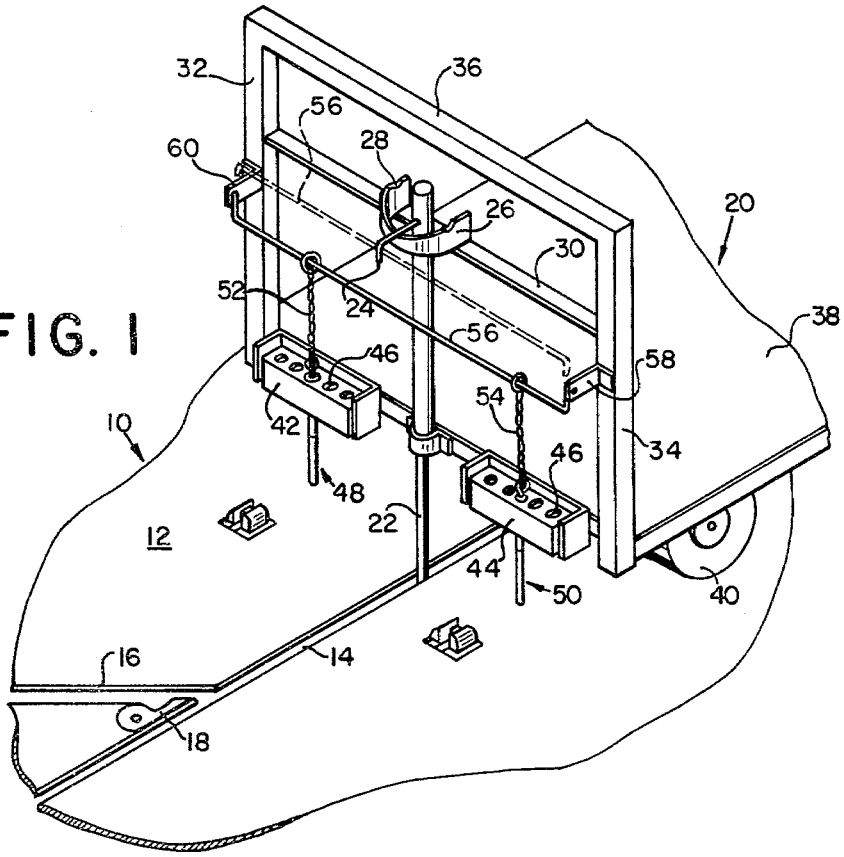
FIG. 1 is a partial perspective view of a tow truck system wherein the tow truck incorporates the novel selector pin of the present invention.

Referring to the drawings in detail, wherein like numerals indicate like elements, there is shown in FIG. 1 a tow truck system designated generally as 10. The system 10 includes a floor 12 having a main slot 14 intersected at spaced points therealong by shunt slots such as shunt slot 16. Movement of the tow truck from along the main slot 14 to movement along the shunt slot 16 is controlled by selectively operable diverter 18.

A vehicle or tow truck 20 is mounted for movement along the main slot 14 and is guided therealong by tow pin 22. The tow pin 22 extends downwardly through the slot 14 for contact at its lower end with a drive conveyor. The upper end of the tow pin 22 is provided with a handle 24. Handle 24 is supported by a cam 26. Cam 26 has a central notch which supports the handle 24 when the tow pin has its lowermost end extending through the slo 14 and is in contact with the drive conveyor as illustrated. Cam 26 has at least one upper notch 28 wherein the handle 24 may be supported and the lowermost end of the tow pin will be above floor level.

Cam 26 is supported by bridgework at the front end of the truck 20. Such bridgework includes a cross bar 30 supported at its ends by uprights 32, 34. A rail 36 extends across the upper end of the uprights 32, 34. The turck 20 is provided with a platform 38 supported by wheels 40.

At the front end of the truck 20, there is provided first and second selector pin support members 42 and 44. The support members are on opposite sides of the tow pin 22. Each of the members 40, 44 are identical. Hence, only member 42 will be described in detail.

Support member 42 is channel-shaped in cross-section. Aligned holes are provided in each of the horizontal legs of member 42 at spaced points therealong. A selector pin 48 extends through one pair of aligned holes 46 on member 42. A comparable selector pin t0 extends through a pair of holes 46 on member 44. Pins 48 and 50 are identical.

The upper end pin 48 is attached to one end of a chain 52. The upper end of pin 50 is attached to one end of a chain 54. The upper ends of chains 52 and 54 are attached to a ring which is slideable along a bar 56. Bar 56 has its ends pivotably supported by brackets 58 and 60. Bar 56 may pivot from the solid line position shown which is its lowermost position to an uppermost position as indicated by the phantom lines. Hence, when it is desired to simultaneously move the selector pins 48 and 50 so that the same are raised from the operative position shown to an inoperative position, the bar 56 is rotated from the solid line position to the phantom position shown in FIG. 1.

Figure 2:
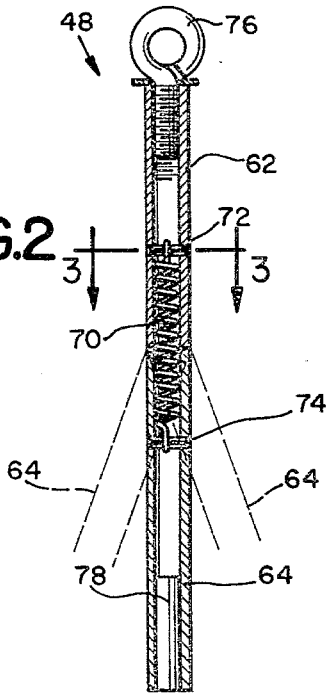
FIG. 2 is a vertical sectional view of the selector pin.
Figure 3:
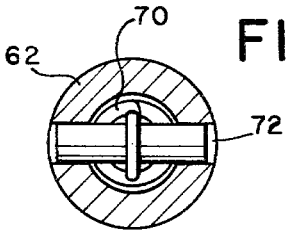
FIG. 3 is a sectional view taken along the line 3—3 in FIG. 2 but on an enlarged scale.

Since the selector pins 48 and 50 are identical, only selector pin 48 will be described in detail. As shown more clearly in FIG. 2, the selector pin 48 includes a first tube 62 and a second tube 64 coaxial therewith. A spring 70 partially disposed within each tube maintains the end faces 66, 68 in intimate contact and maintains the tubes coaxial.

One end of spring 70 is fixedly secured to tube 62 by means of a roll pin 72. The other end of spring 70 is fixedly secured to tube 64 by means of a roll pin 74. The distance between roll pins 72, 74 is greater than the length of spring 70 whereby spring 70 is in tension. By way of example and not by way of limitation, spring 70 may be 2 inches in its normal neutral state, while being placed in tension by being stretched so as to have a length of 2½ inches which corresponds to the distance between the axes of the roll pins 72, 74. The diameter of the spring 70 is slightly less than but substantially equal to the inner diameter of the tubes 62, 64.

The selector pin 48 may mechanically trip a switch or may electrically trip a switch. Electrical actuation of a switch is attained by permanent magnet 78 which is fixedly secured at the terminal end of tube 64 in any convenient manner such as by the use of adhesives. An eye bolt 76 is threadly connected to the uppermost end of the tube 62. The eye bolt 76 facilitates a loop for connecting the selector pin 48 to the chain 52. A preferred embodiment of the selector pin 48 includes the following details. The tubes are made from a non-magnetic material such as aluminum or a polymeric plastic with tube 62 being shorter than tube 64. Thus, tube 62 may have a length of 3½ inches while tube 64 has a length of 4½ inches. The interface between the tubes must occur below the elevation of the member 42 but adjacent thereto. Each of the tubes 62, 64 has a nominal outer diameter of 9-1/6 inch and a nominal inner diameter of 0.3145 inch.

Figure 4:
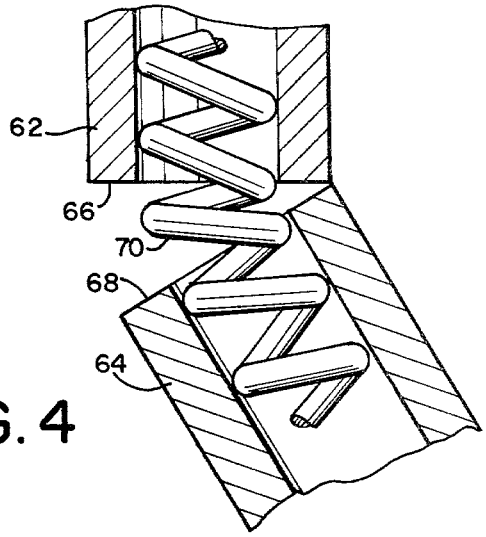
FIG. 4 is a partial sectional view of the tubes of the selector pin on an enlarged scale and the second tube being angularly disposed with respect to the first tube.

The spring 70 is a commercially available coil spring made from spring wire having a diameter of 0.049 inch. The outer diameter of the spring is approximately 0.3125 inch so as to provide a clearance of 0.002 inches the outer diameter of the spring and the inner diameter of the tubes. Such clearance is preferably less than about 0.005 inches. The ability of the spring 70 to return the tube 64 to a position where it is coaxial with tube 62 is attained due to the relationship between the outer diameter of spring 70 and the inner diameter of the tubes. Tube 64 may be deflected to a position as shown in FIG. 4, through an angle of 0° to 90°, when subjected to a laterally directed force exceeding the spring tension. The roll pins 72, 74 are each spaced from the associated end face of their respective tubes by an equal distance such as 1¼ inch.

When made from aluminum, the tubes 62, 64 are preferably alloy No. 2024-T3 which has an ultimate tensile strength of 70,000 lbs./in.$^2$, a yield strength of 50,000 lbs./in.$^2$, a shear strength of 41,000 lbs./in.$^2$, a fatigue strength of 20,000 lbs./in.$^2$, and a granel hardness of 120.

Thus, it will be noted that there has been disclosed herein a selector pin structurally interrelated in a novel manner whereby the lower end of the selector pin will be deflected through an angle up to 90° when it inadvertently contacts an object and the lower portion of the selector pin will be automatically realigned with the upper portion without any damage to the selector pin. No special equipment is needed to manufacture the selector pin. A selector pin in accordance with the present invention was subjected to 92,000 impacts against tube 64 without any damage to the selector pin, and spring 70 continued to realign tube 64 so as to be coaxial with tube 62. In view of the state of the art and the above description, a detailed statement of operation is not deemed necessary.

The present invention may be embodied in other specific forms without departing from the spirit or essential attributes thereof and, accordingly, reference should be made to the appended claims, rather than to the foregoing specification as indicating the scope of the invention.

I claim:

1. A selector pin comprising first and second tubes aligned end to end, a coil spring within said tubes, the outer diameter of said spring being closely adjacent to the inner diameter of said tubes, one end of said spring being anchored to said first tube and the other end of said spring being anchored to said second tube in a manner so that the spring is under tension and maintains the juxtaposed end faces in coaxial contact while permitting the second tube to pivot relative to the first tube when the second tube is subjected to a laterally directed force exceeding the spring tension, and means connected only to said first tube for enabling said tubes to be supported on a vehicle in an upright position.

2. A selector pin in accordance with claim 1 wherein said means is an eye bolt connected to the end of said first tube remote from said spring.

3. A selector pin in accordance with claim 1 including a magnet connected to the end of said second tube remote from said spring.

4. A selector pin in accordance with claim 1 wherein the ends of said spring are connected to said tubes by roll pins, the roll pins being equally spaced from said juxtaposed end faces.

5. A selector pin in accordance with claim 1 wherein said tubes are made of aluminum with the second tube being longer than the first tube.

6. A selector pin in accordance with claim 1 wherein each tube is longer than said spring.

7. A selector pin comprising first and second cylindrical tubes having the same inner and outer diameters, said tubes being aligned end to end, a spring within said tubes, the outer diameter of said spring being less than the inner diameter of said tubes by a dimension not more than about 0.005 inches, means anchoring one end of said spring to said first tube, means anchoring the other end of said spring to said second tube, said spring being under tension and maintaining the juxtaposed end faces in coaxial contact while permitting the second tube to pivot relative to the first tube when the second tube is subjected to a laterally directed force exceeding the spring tension, and means connected to the free end of said first tube for enabling said tubes to be supported on a vehicle in an upright position.

8. A selector pin in accordance with claim 7 wherein said last-mentioned means is an eye bolt threadedly connected to the inner surface of said first tube.

9. A selector pin in accordance with claim 7 including a permanent magnet secured to a free end of said second tube, said second tube being made from a non-magnetic material.

* * * * *